US009181604B2

(12) United States Patent
Fray et al.

(10) Patent No.: US 9,181,604 B2
(45) Date of Patent: Nov. 10, 2015

(54) TREATMENT OF TITANIUM ORES

(75) Inventors: Derek J. Fray, Cambridge (GB); Shuqiang Jiao, Cambridge (GB)

(73) Assignee: Chinuka Limited, London (GB)

( * ) Notice: Subject to any disclaimer, the term of this patent is extended or adjusted under 35 U.S.C. 154(b) by 130 days.

(21) Appl. No.: 13/386,891

(22) PCT Filed: Jul. 28, 2010

(86) PCT No.: PCT/GB2010/051237
§ 371 (c)(1),
(2), (4) Date: Mar. 2, 2012

(87) PCT Pub. No.: WO2011/015845
PCT Pub. Date: Feb. 10, 2011

(65) Prior Publication Data

US 2012/0152756 A1 Jun. 21, 2012

(30) Foreign Application Priority Data

Aug. 6, 2009 (GB) ..... 0913736.5

(51) Int. Cl.
*C22B 34/12* (2006.01)
*C25C 3/28* (2006.01)

(52) U.S. Cl.
CPC ..... *C22B 34/129* (2013.01); *C25C 3/28* (2013.01)

(58) Field of Classification Search
USPC ..... 205/47, 397, 398, 399, 400, 401
See application file for complete search history.

(56) References Cited

U.S. PATENT DOCUMENTS

| | | | | |
|---|---|---|---|---|
| 2,707,169 | A * | 4/1955 | Steinberg et al. | 205/401 |
| 2,722,509 | A | 11/1955 | Wainer | |
| 2,739,111 | A * | 3/1956 | Noland et al. | 205/45 |
| 2,792,310 | A * | 5/1957 | Steinberg et al. | 501/87 |
| 2,833,704 | A * | 5/1958 | Wainer | 75/10.26 |
| 2,868,703 | A * | 1/1959 | Wainer | 205/401 |
| 2,904,426 | A * | 9/1959 | Wainer | 75/10.26 |
| 2,994,650 | A * | 8/1961 | Slatin | 205/47 |
| 3,125,497 | A * | 3/1964 | Hansen | 423/19 |
| 3,627,483 | A * | 12/1971 | Cole et al. | 423/135 |
| 3,660,029 | A * | 5/1972 | Naguib | 423/80 |
| 4,116,801 | A * | 9/1978 | Juckniess et al. | 204/247 |
| 4,400,247 | A | 8/1983 | Ginatta | |
| 6,712,952 | B1 * | 3/2004 | Fray et al. | 205/640 |
| 7,638,026 | B1 * | 12/2009 | Willit et al. | 205/47 |

(Continued)

FOREIGN PATENT DOCUMENTS

| | | |
|---|---|---|
| CN | 1712571 A | 5/2005 |
| GB | 778354 | 7/1957 |

(Continued)

OTHER PUBLICATIONS

Machine translation of Zhu et al (CN 1712571 A).*

(Continued)

*Primary Examiner* — Harry D Wilkins, III
(74) *Attorney, Agent, or Firm* — Kilpatrick Townsend & Stockton LLP

(57) ABSTRACT

A method of producing titanium, comprising providing an oxide of titanium having a level of impurities of at least 1.0 wt %, reacting the oxide of titanium to form a titanium oxycarbide; and electrolyzing the titanium oxycarbide in an electrolyte, with the titanium oxycarbide configured as an anode; and recovering a refined titanium metal from a cathode in the electrolyte.

12 Claims, 4 Drawing Sheets

(56) References Cited

U.S. PATENT DOCUMENTS

| | | | | |
|---|---|---|---|---|
| 2005/0166706 | A1* | 8/2005 | Withers et al. | 75/10.23 |
| 2009/0152507 | A1 | 6/2009 | McCarron et al. | |

FOREIGN PATENT DOCUMENTS

| | | | |
|---|---|---|---|
| RU | 2103391 | C1 | 7/1994 |
| SU | 1416060 | A3 | 5/1981 |
| WO | WO2005/019501 | A2 | 3/2005 |
| WO | WO2007/097823 | A2 | 8/2007 |

OTHER PUBLICATIONS

Ettel et al, "Electroyltic Refining and Winning of Metals", excerpt from Comprehensive Treatise of Electrochemistry Part 2: Electrochemical Processing, 1981, pp. 327-380.*

Haupin et al, "Electrometallurgy of Aluminum", excerpt from Comprehensive Treatise of Electrochemistry Part 2: Electrochemical Processing, 1981, pp. 301-325.*

Sakamura et al, Electrolytic Reduction and Electrorefining of Uranium to Develop Pyrochemical Reprocessing of Oxide Fuels, Nuclear Technology, vol. 171, No. 3, Sep. 2010, pp. 266-275, from 2008 International Pyroprocessing Research Conference.*

OS Kjos, ECS Transactions, "Titanium Production from Oxycarbide Anodes" vol. 16, No. 49, pp. 229-237, especially p. 229.

J. Haussman, "International Round Table on Titanium Production in Molten Salts", 2008, JC Withers, "Recent Improvements for Electrowinning Titanium from Composite Anodes".

CapLUS abstract Accession No. 1973:66175 & Met.Prom., 1971, 194-197, "Possible Use of Titanium Oxycarbides as Soluble Anodes During Electrolytic Production of Titanium Powders"—see Abstract.

Viniti, 1974, 1685-74, Vi Drozdenko, "Electrolysis of Titanium Compounds" & CAPlus Abstract Accession No. 1977:143490.

AM Martinez, "New Method for Low-Cost titanium Production", Key Engineering Materials, vol. 436, May 2010, pp. 41-53.

OS Kjos, "Electrochemical Production of Titanium from Oxycarbide Anodes", 2010, http://www.sintef.no/Home/Pubications/Publication?page=127290.

UK Search Report—Date of Search Report: Aug. 20, 2010, Application GB1012653.0.

Kjos, O.S. et al., "Titanium Production from Oxycarbide Anodes", ECS Transactions, Electrochemical Society, U.S., vol. 16, No. 49, Jan. 1, 2008.

Jiao et al., "Electrolysis of Ti250 Solid Solution Prepared by TiC and Ti02", Journal of Alloys and Compounds, Elsevier Sequoia, Lausanne, CH, vol. 438, No. 1-2, May 6, 2007, pp. 243-246.

H. Elstad, *Equilibrium between titania slags and metallic iron*, The 6$^{th}$ International Heavy Minerals Conference 'Back to Basics', The Southern African Institute of Mining and Metallurgy, pp. 35-42, 2007.

Digital Fire Reference Database, Digitalfire Ceramic Materials Database, Rutile, Iron Titanium Mineral, http://digitalfire.com/4sight/material/rutile_1204.html, 8 pages, Aug. 27, 2012.

Examination Report, U.K. Intellectual Property Office, Mar. 19, 2012.

* cited by examiner

| Element | Weight % | Atomic % |
|---|---|---|
| Ti K | 100.00 | 100.00 |
| Totals | 100.00 | |

TREATMENT OF TITANIUM ORES

FIELD OF THE INVENTION

The present invention relates to a method of producing titanium, particularly but not exclusively from an ore comprising titanium dioxide and at least 1.0 wt % impurities including calcium oxide and iron oxide.

BACKGROUND ART

Titanium is a metal with remarkable properties but its applications are restricted due to the high cost of its extraction and processing. Using the Kroll or Hunter Processes requires high purity titanium tetrachloride which is either reduced with magnesium (Kroll Process) [W. J. Kroll, Trans. Electrochem. Soc., 78 (1940) 35-57] or sodium (Hunter Process) [M. A. Hunter, J. Am. Chem. Soc., 32 (1910) 330-336]. The high purity titanium tetrachloride is produced by carbo-chlorination of the impure titanium dioxide and as all the oxides chlorinate, the impurities are removed by selective distillation of the chlorides. The other way of making high purity titanium dioxide, usually for the pigment industry, is the sulphate route where the impure titanium dioxide is dissolved in sulphuric acid and the iron, which is the major impurity, precipitated as iron oxide. However, there are several sources of titanium oxide which contain impurities or are too fine and render the conventional routes impractical. For example, titanium ores containing significant quantities of calcium oxide form in the carbo-chlorination process, calcium chloride which melts below the temperature of the fluidised bed reactor. This liquid phase de-fluidises the bed. The particle size of some other ore bodies are too fine to remain in a fluidised bed and are simply swept away. Use of the sulphuric acid route results in the formation of stable calcium sulphate when calcium oxide containing ores are leached. It would be advantageous if these materials could be simply converted into high purity titanium.

As mentioned above, there are two commercial methods, Kroll and Hunter, for the production of titanium using high purity titanium chloride with the vast majority being produced by the Kroll Process. In order to reduce the cost of titanium production, other methods have been investigated, usually starting with high purity oxide. In laboratory and pilot plant scale experiments, titanium dioxide has been reduced using calcium dissolved in calcium chloride (OS Process) [R. O. Suzuki in "Ti-2003 science and technology". Eds G. Lutjering and J. Albrecht, (2004, Wiley-VCH, Weinheim) 245-252.] or electrochemically by electro-deoxidation in molten calcium chloride (FFC Cambridge Process) [G. Z. Chen, D. J. Fray and T. W. Farthing, Nature 407 (2000) 361-364]. In the latter process, the titanium oxide is made the cathode in a bath of calcium chloride and it is found that the cathodic reaction is not the deposition of calcium from the melt but the ionisation of the oxygen in the titanium dioxide, which diffuses to the anode and is discharged. In both these processes, ores containing calcium oxide can be treated as the calcium oxide would simply dissolve in the salt. However, there would not be any selective removal of the other elements as the final product would be a reflection of the impurities in the original feed material. Other processes, such as the Armstrong Process—'Summary of emerging titanium cost reductions', EHK Technologies. Report prepared for US Department of Energy and Oak Ridge National Laboratory, subcontract 4000023694 (2003) which is a derivative of the Hunter Process, all require high purity titanium tetrachloride as the feedstock.

Another process of interest, is that patented by Wainer in the 1950s [U.S. Pat. No. 2,722,509], which describes a process where equimolar amounts of finely divided chemically pure titanium carbide and finely divided chemically pure titanium monoxide were intimately admixed and heated in an argon atmosphere to form a TiC.TiO anode, a mutual solid solution of titanium carbide and titanium monoxide in which the molar ratio of the carbide to the monoxide does not exceed 1. A melt of a chloride salt of an electropositive element is used as an electrolyte and when a voltage is applied, anodic reactions of the following type occur:

$$TiCO = Ti^{2+} + CO + xCO + 2e^{-}$$

The titanium ions dissolve into the electrolyte, and are reduced at the cathode:

$$Ti^{2+} + 2e = Ti$$

Withers and co-workers have also investigated thermal and electrochemical processes for production of titanium see WO 2005/019501 and WO 2007/097823. The process involves forming a titanium oxide-carbon composite by mixing titanium oxide with a source of carbon and heating in the absence of air to a temperature sufficient to reduce the plus four valance of the titanium in the $TiO_2$ to a lower valence and form a titanium suboxide/carbon composite electrode. In the process of forming the titanium suboxide/carbon composite electrode, any iron oxide is reduced to iron and was removed by leaching or complexing the iron in an aqueous solution at ambient temperature. WO 2005/019501 suggests that by incorporating other oxides into the anode, it is possible to reduce these other oxides at the same time, and deposit the cations simultaneously at the cathode to produce an alloy which reflects the composition of the original anode. In the same document, a method of producing high purity titanium is described which uses the same conditions as the previous experiments. These two results are totally inconsistent.

The present applicant has sought to provide a method of refining titanium from an ore comprising titanium dioxide and relatively high levels (e.g. at least 1.0 wt %) impurities including calcium oxide and iron oxide.

STATEMENT OF INVENTION

According to a broad aspect, the present invention provides electrorefining of an anode consisting of an oxycarbide to give a pure metallic material at the cathode.

In accordance with another aspect of the present invention, there is provided a method producing titanium, comprising: providing an oxide of titanium having a level of impurities of at least 1.0 wt %; reacting the oxide of titanium to form a titanium oxycarbide; electrolysing the titanium oxycarbide in an electrolyte, with the titanium oxycarbide configured as an anode; and recovering a refined titanium metal from a cathode in the electrolyte.

The present applicant has surprisingly found that by electrolysing the titanium oxycarbide, titanium metal with a relatively high purity compared to the impurity levels in the oxide of titanium is deposited at the cathode. The refined titanium metal may have a level of impurities of less than 0.5 wt %, i.e. be at least 99.5% pure by weight, and may even be at least 99.8% pure by weight. The present applicant has found that impurities initially present in the oxide of titanium, which might be expected to be deposited at the cathode with the titanium, are retained in the electrolyte.

The oxide of titanium may be an ore or ore concentrate. The oxide of titanium may comprise impurities selected from the group consisting of oxides of silicon, aluminium, iron, calcium, chromium and vanadium. In one arrangement, the oxide of titanium has impurities including oxides of iron and/or calcium. The presence of such impurities interferes with extraction of titanium using conventional techniques, particularly if the oxides of calcium and/or iron are present in significant quantities. For example, the presence of more than about 0.15 wt %-0.2 wt % calcium oxide may preclude processing in a fluidised bed reactor due to melting of calcium chloride resulting from an earlier carbo-chlorination step. Consequently, an ore containing titanium dioxide and significant levels of calcium oxide and iron oxide has a significantly lower value than other ores with nothing more than minimum or trace levels of calcium oxide and/or iron oxide.

The oxide of titanium may have a level of impurities of at least 2.0 wt %, perhaps even at least 2.5 wt %. The oxide of titanium may include at least 0.1 wt % calcium oxide, perhaps even at least 0.5 wt % calcium oxide. Additionally or alternatively, the oxide of titanium may include at least 0.1 wt % iron oxide, perhaps at least 0.5 wt % iron oxide, and perhaps even at least 5 wt % iron oxide. The refined titanium metal may include a lower level of calcium and/or iron than the oxide of titanium.

The oxide of titanium may substantially comprise titanium dioxide. For example, the oxide of titanium may comprise at least 90 wt % titanium dioxide, and possibly even at least 95 wt % titanium dioxide. The titanium oxycarbide may be formed by reacting the oxide of titanium with titanium carbide in relative amounts to form a Ti—C—O solid solution. For example, powders of the oxide of titanium and titanium carbide may be admixed and sintered to form the Ti—C—O solid solution. If the oxide of titanium substantially comprises titanium dioxide, it may be admixed with titanium carbide in relative amounts to achieve a stoichiometric reaction given by $$4TiC+2TiO_2=3Ti_2CO+CO_{(g)}.$$

The electrolyte may be a molten salt, and may comprise a chloride of an alkali or alkali-earth metal. The molten salt may be selected from the group consisting of lithium chloride, sodium chloride, potassium chloride, magnesium chloride and mixtures thereof. The molten salt may comprise a sodium chloride-potassium chloride eutectic or a lithium chloride-sodium chloride-potassium chloride eutectic. Alternatively, the molten salt may be magnesium chloride. Such a salt boils at 1412° C. and is distilled away from the cathodic product; the other salts can only be removed by dissolving in water which causes the titanium to be oxidised. The molten salt may further comprise titanium (II) chloride ($TiCl_2$) and/or titanium (III) chloride ($TiCl_3$). The presence of titanium chloride (perhaps a few percent by weight) may help transportation of titanium ions through the salt.

The method may further comprise removing impurities from the electrolyte by treating the molten electrolyte with titanium, for example at a temperature of 700° C.

In accordance with another aspect of the present invention, there is provided a method of refining titanium, comprising: providing a titanium ore or ore concentrate comprising titanium dioxide; reacting the titanium ore or ore concentrate to form a titanium oxycarbide; electrolysing the titanium oxycarbide in an electrolyte, with the titanium oxycarbide configured as an anode; and recovering titanium from a cathode in the electrolyte.

The titanium ore or ore concentrate may comprise impurities (as defined with the previous aspect). The formation of the titanium oxycarbide may comprise reacting the titanium dioxide with titanium carbide (as defined with the previous aspect). The recovered titanium may have a higher purity (lower level of impurities in relative terms), with the level of titanium increasing from less than 98% by weight in the ore or ore concentrate to at least 99.5% by weight in the recovered titanium, and possibly even at least 99.8% by weight.

BRIEF DESCRIPTION OF DRAWINGS

An embodiment of the invention will now be described in detail, by way of example, and with reference to the accompanying drawings, in which.

SPECIFIC DESCRIPTION OF EMBODIMENT OF INVENTION

Figure 1:
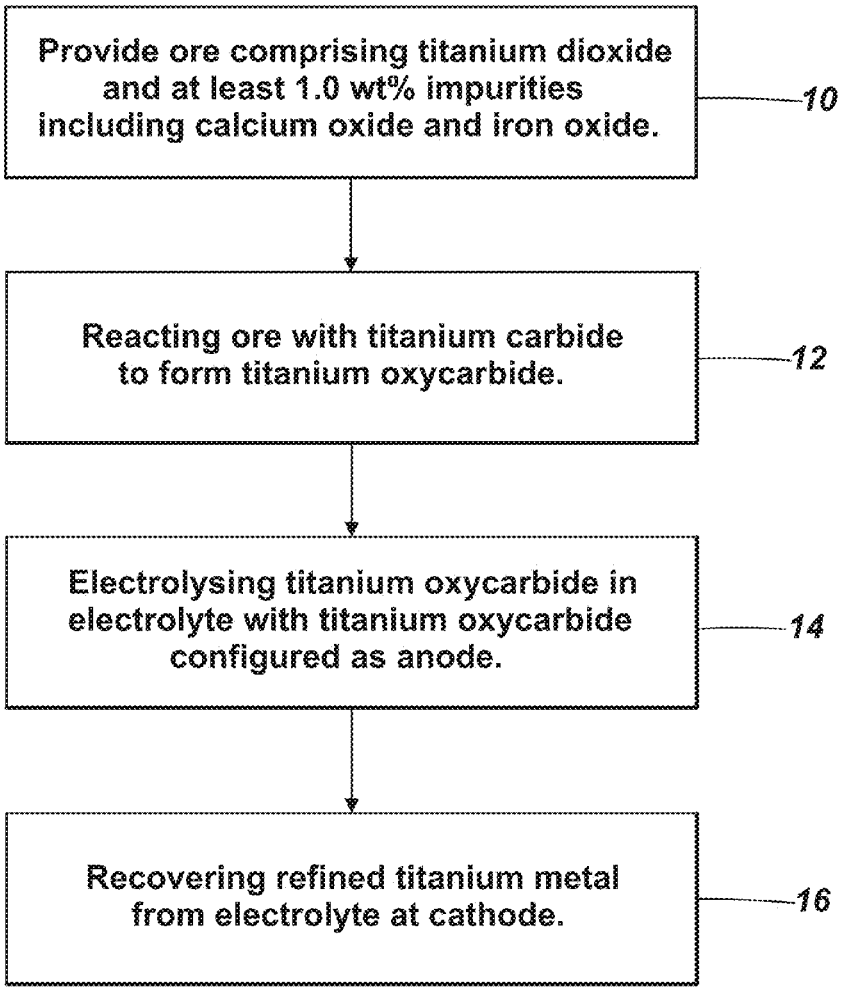
FIG. 1 is a flow chart illustrating a method embodying the present invention.

Electrorefining in molten salts is used commercially to produce high purity molten aluminium by dissolving the aluminium into a copper-aluminium alloy. This is made the anode and the aluminium being the most reactive element is ionised into the salt and deposited at the cathode with the impurities remaining in the anode. The ionisation potentials for the pure elements for a chloride melt relative to $Na/Na^+$, at 1173 K, are $$Al=Al^{3+}+3e\ E^o=+1.50\ V$$

$$Si=Si^{4+}+4e\ E^o=+2.10\ V$$

$$Mn=Mn^{2+}+2e\ E^o=+1.41\ V$$

$$Fe=Fe^{2+}+2e\ E^o=+1.86\ V$$

Manganese should ionise first followed by Al, Fe and Si but as the quantity of manganese is usually very small, aluminium ionises first.

The same principle can be applied to the refining of titanium but in this invention, the reactions are not the refining of titanium metal but refining metal from metal oxides. A typical composition of an ore is given in Table 1.

TABLE 1

Analysis of a typical commercial Rutile Concentrate

| Element | Assay % |
|---|---|
| $TiO_2$ | 96.5 |
| $SiO_2$ | 1.40 |
| $Al_2O_3$ | 0.26 |
| $Fe_2O_3$ | 0.55 |
| MgO | 0.07 |
| CaO | 0.66 |
| $Na_2O$ | 0.08 |
| $K_2O$ | 0.01 |
| $P_2O_5$ | <0.01 |
| MnO | <0.01 |
| $Cr_2O_3$ | 0.31 |
| $V_2O_5$ | 0.30 |
| LOI | 0.07 |

TABLE 1-continued

| Analysis of a typical commercial Rutile Concentrate | |
|---|---|
| Element | Assay % |
| $U_3O_8$ | 0.0004 |
| $ThO_2$ | <0.002 |
| As | <0.001 |
| S | 0.03 |

If this material is reacted with C to form $TiC_xO_y$ and other oxycarbides, the reactions in Table 2 will occur when the material is made anodic.

TABLE 2

| Potentials relative to $Na = Na^+ + e$ | |
|---|---|
| Reaction | Potential relative to $Na/Na^+$ at 1073 K (V) |
| $TiO + C = Ti^{2+} + 2e + CO(g)$ | 2.85 |
| $CaO + C = Ca^{2+} + 2e + CO(g)$ | 1.45 |
| $FeO + C = Fe^{2+} + 2e + CO(g)$ | 1.92 |
| $Cr_2O_3 + 3C = 2Cr^{2+} + 6e + 3CO(g)$ | 2.47 |
| $MgO + C = Mg^{2+} + 2e + CO(g)$ | 2.11 |
| $SiO_2 + 2C = Si^{4+} + 4e + 2CO(g)$ | 2.87 |

The order of ionisation should be calcium, iron, magnesium, chromium, titanium and then silicon, ie calcium should be removed as calcium ions, followed by Fe as $Fe^{2+}$, etc. However these are for pure metal oxides whereas in the ore, it is likely that the oxides form a solid solution and their activities, except for TiO, will be considerably reduced. An activity of $2\times10^{-5}$ will alter the potential by 0.5 V, so that the only firm conclusion is that calcium will ionise first followed by the other elements. Once in the electrolyte, the deposition potentials should be given by Table 3 and the order of deposition chromium, iron, titanium magnesium and, finally, calcium.

TABLE 3

| Potentials relative to $Na^+ + e = Na$ | |
|---|---|
| Reaction | Potential relative to $Na^+ + e = Na$ (V) |
| $Cr^{2+} + 2e = Cr$ | 2.07 |
| $Mg^{2+} + 2e = Mg$ | 0.83 |
| $Ti^{2+} + 2e = Ti$ | 1.68 |
| $Fe^{2+} + 2e = Fe$ | 1.99 |
| $Ca^{2+} + 2e = Ca$ | −0.18 |

Again, these deposition potentials will be influenced by the activities or concentration of the ions in the salt so that if the concentration of the species is low, it will be more difficult to deposit the metal form that species.

The overall conclusion of these calculations is that it is very likely the calcium, being highly electropositive, will be retained by the electrolyte. Surprisingly, it was found that by electrorefining the oxycarbide, made from an ore with the composition given in Table 1, titanium with a very low impurity content of the other elements was deposited on the cathode.

Example

A broad method of producing titanium from an ore (such as the ore whose composition is given in Table 1) is illustrated in FIG. 1. Having provided the ore at step 10, a titanium oxycarbide is formed at step 12. The titanium oxycarbide is electrolysed at step 14, and refined titanium metal recovered at the cathode at step 16.

The oxycarbide was prepared (step 12) by mixing an ore of the composition shown in Table 1 in accordance with the stoichiometry given by the equation:

$$4TiC+2TiO_2=3Ti_2CO+CO\ (g).$$

Figure 2:
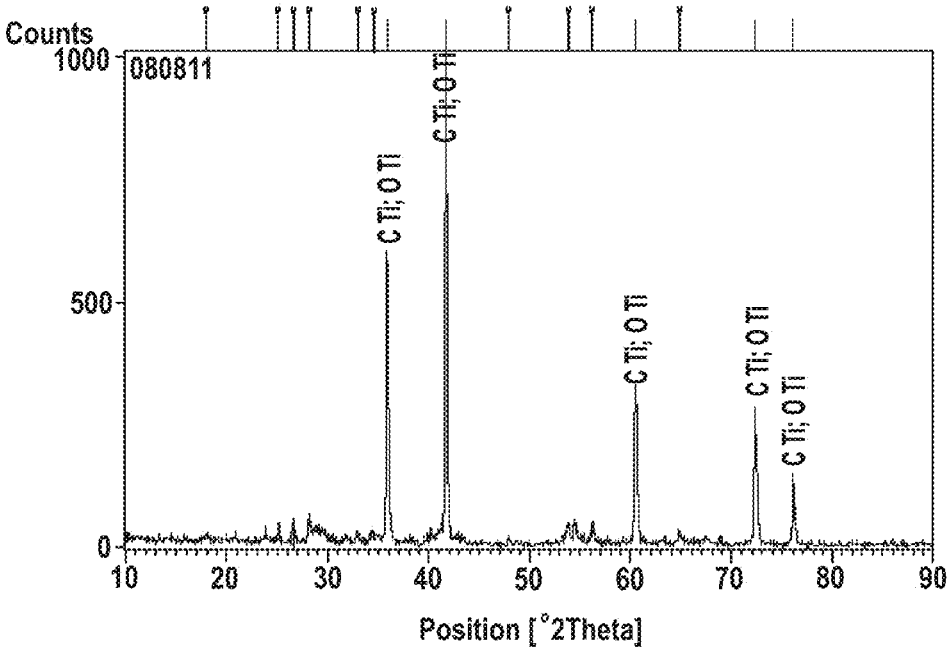
FIG. 2 is an XRD pattern of a Ti—C—O solid solution prepared in accordance with one step of the present invention.

The powders were pressed into pellets 2 mm diameter and 2 mm thickness using an uniaxial pressure of 2.65 tons $cm^{-2}$. The pellets were sintered in a vacuum furnace at 1373 K under a vacuum of $10^{-2}$ Torr. The pellets, after sintering, were homogeneously black and the X-ray pattern (FIG. 2) shows that the pellet was constituted by the Ti—C—O solid solution.

Figure 3:
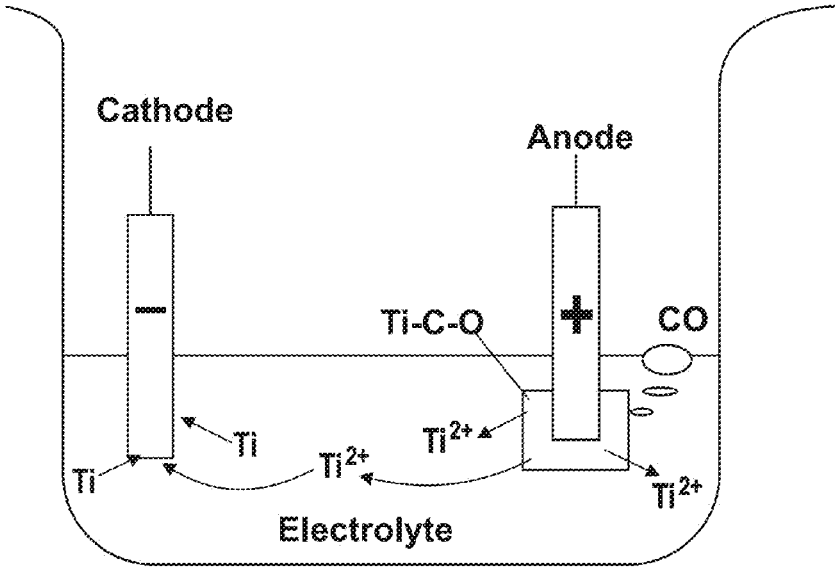
FIG. 3 is a schematic diagram of an electrorefining cell in accordance with another step of the present invention.
Figure 4:
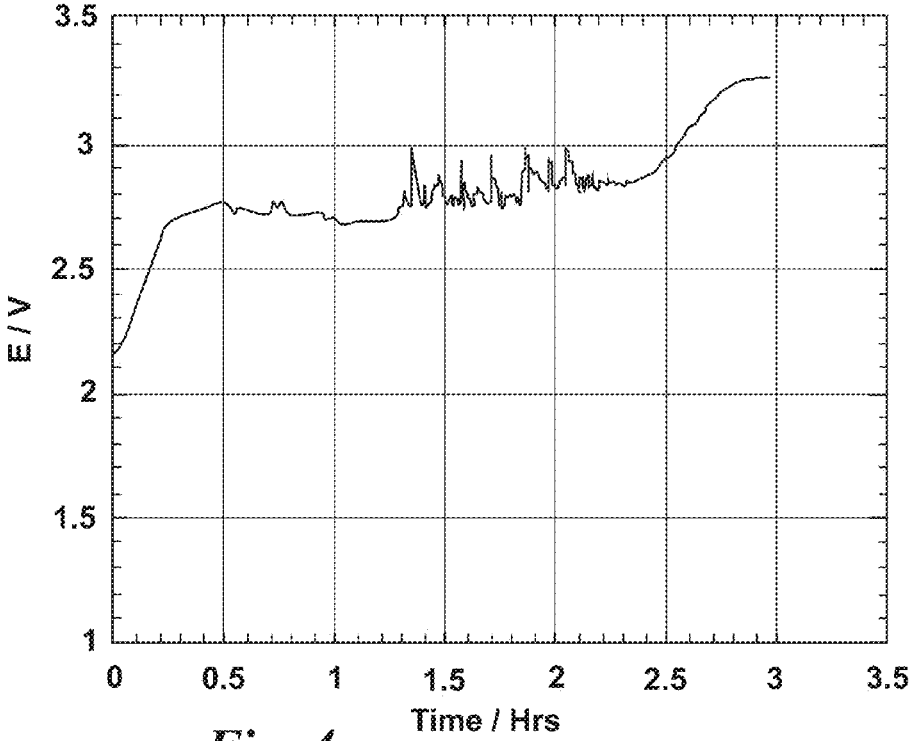
FIG. 4 shows potential profiles during anodic dissolution of Ti—O—C.

A schematic of the electrorefining cell is shown in FIG. 3. The titanium oxycarbide (Ti—C—O) is configured as the anode and electrolysed in an electrolyte (step 14). The electrolytes that were used were either eutectic NaCl—KCl or eutectic LiCl—NaCl—KCl, containing some $TiCl_2$ and $TiCl_3$. A series of galvanostatic electrolyses were carried out in the current density range from 50 to 100 mA $cm^{-2}$ From FIG. 4, it can be seen that the potential is essentially constant but rises to the decomposition potential of the bulk salt when the anode had been consumed and the lead wire was acting as the anode.

The anode and cathode current efficiencies were calculated assuming that the valency of the titanium ion in the solution was 2.5. It was assumed that the following electrochemical reactions took place during the electrorefining:

TABLE 3

| Experiment Sequence | Temperature (° C.) | Cell voltage (V) | Anode Remaining (%) | Anode current efficiency (vs $Ti^{2.5+}$)* | Cathode Current Efficiency (vs $Ti^{2.5+}$)* |
|---|---|---|---|---|---|
| 1 | 570 | 1.6 | 2.1 | 88.3 | 38.6 |
| 2 | 570 | 1.8 | 3.2 | 82.6 | 42.1 |
| 3 | 620 | 1.6 | — | 94.2 | 50.6 |
| 4 | 620 | 1.8 | 1.7 | 87.6 | 39.5 |
| 5 | 670 | 1.6 | 3.4 | 80.5 | 44.3 |
| 6 | 670 | 1.8 | 3.8 | 81.8 | 47.6 |

Anode: $Ti = Ti^{3+} + 3e$ and $Ti = Ti^{2+} + 2e$

Cathode: $Ti^{3+} + e = Ti^{2+}$ and $Ti^{2+} + 2e = Ti$

*Anode and cathode current efficiencies on the assumption that the electrolyte contains a 50/50 mixture of $Ti^{3+}/Ti^{2+}$.

From Table 3, it is clear that most of the titanium and some of the impurities dissolved in the salt. However, the high $Ti^{3+}$ concentration lowered the current efficiency at the cathode.

Figure 5:
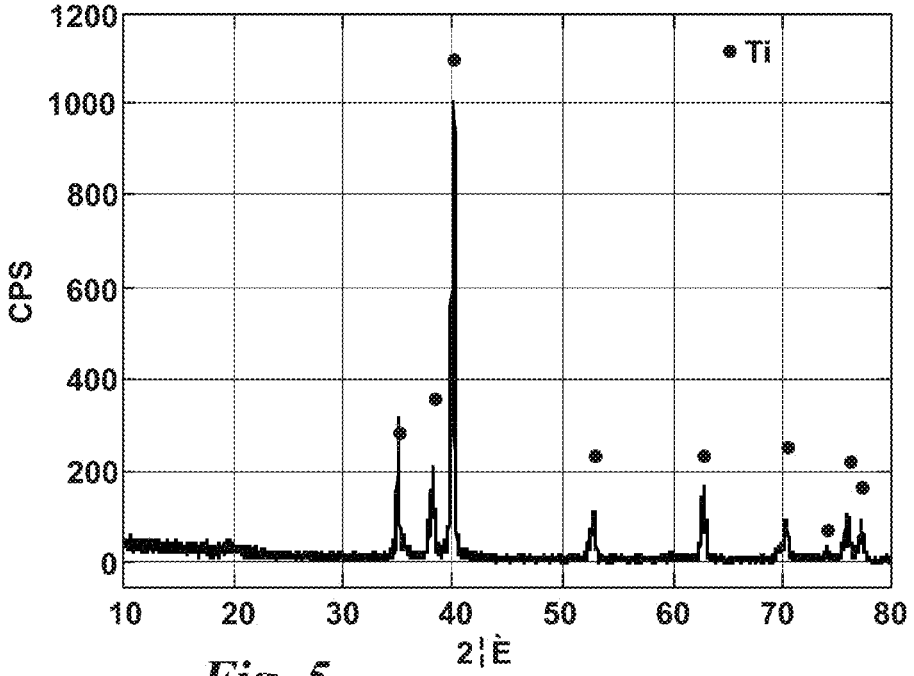
FIG. 5 shows X-ray spectra of the refined titanium metal recovered at the cathode.
Figure 6A:
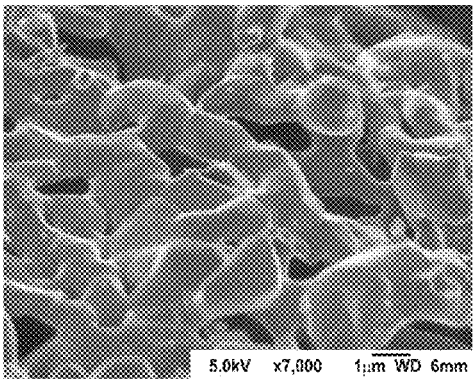
FIGS. 6*a* and 6*b* are SEM micrographs of the refined titanium metal recovered at the cathode.
Figure 6B:
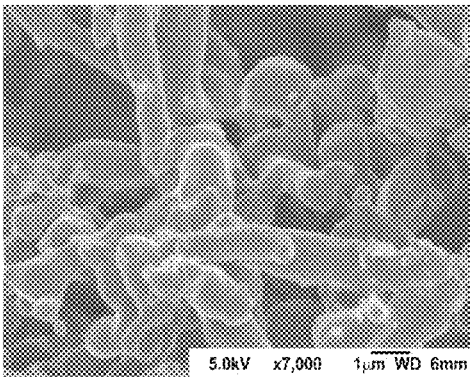
Figure 7:
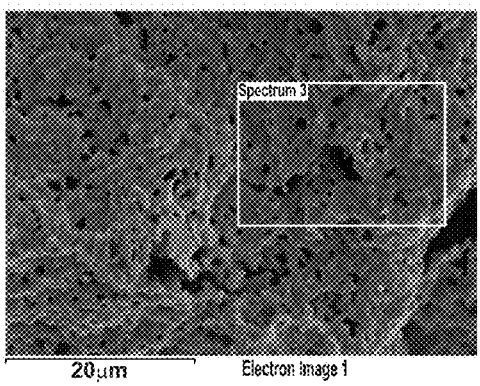
FIG. 7 shows EDS spectrum for the refined titanium metal recovered at the cathode.
Figure 7:
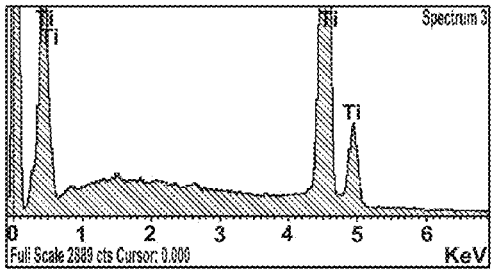

Metal deposited at the cathode during electrolysis (step 16) was collected. Such metal was physically broken and washed and FIG. 5 shows the X-ray spectra, FIG. 6, the microstructure, and FIG. 7, the EDS spectrum. This conclusively shows that relatively pure titanium was deposited at the cathode.

The impurities of the cathodic product were analysed by inductively coupled plasma. The electrorefined product as described above was prepared from the ore concentrate, presented in Table 1. It can be seen (see Table 4), compared to their composition in the ore concentrate, that the main metal elements have been reduced to a very low level (typically by about one order of magnitude or more) except iron. The relatively high iron composition in the cathodic product could be partly because a steel bar was used as a cathode, which contaminated the cathodic product when physically removing from the electrode.

TABLE 4

The composition of the impurities in the starting and end products.

| Sample | Al(%) | Ca(%) | Cr(%) | Fe(%) | Si(%) |
|---|---|---|---|---|---|
| Concentrate | 0.232 | 0.782 | 0.350 | 0.660 | 1.540 |
| Electrorefined Product | 0.032 | 0.079 | 0.029 | 0.130 | <0.001 |

As can be seen, there has been a reduction in a significant number of the elements so the quality of titanium has increased from 96.44% (in the concentrate) to 99.73% which is a substantial increase.

An Induction Coupled Plasma Unit (ICP) was used to analyze the impurities in the molten salt after the experiments. The cell contained 260 g of the NaCl—KCl electrolyte and for every electrolysis, around 0.326 g of Ti—C—O anode was used and electrolysis was performed under a cell voltage of 0.6V. After electrolysis around 1 g salt was taken out from the bulk electrolyte and dissolved in high purity water. The concentration of the impurities was analyzed by ICP and the results are shown in Table 5.

TABLE 5

The composition of the impurities in salt after electrolysis (the electrolyte was used four times)

| Sample | Al(ppm) | Ca(%) | Cr(%) | Fe(%) | Si(%) |
|---|---|---|---|---|---|
| Blank | 0 | 0 | 0 | 0 | 0 |
| After 1st electrolysis | 0.00176 | 0.33831 | 0.00558 | 0.00104 | — |
| After 2nd electrolysis | 0.00122 | 0.76268 | 0.03040 | 0.00098 | 0.04148 |
| After 3rd electrolysis | 0.00166 | 1.38767 | 0.03570 | — | 0.05111 |
| After 4th electrolysis | 0.00219 | 1.62361 | 0.03753 | 0.00407 | 0.05483 |

It can be seen that most of the impurities have been anodically dissolved into molten salt where they remain. In general, the quantity of impurities increases with use of the electrolyte but the increases are not uniform. This may be due to heterogeneity in the composition of the pellets. The elements Ca, Cr, Fe and Si build up as ions in the salt whilst the Al is lost from the melt as aluminium chloride which has a very high vapour pressure. Calcium has too high a deposition potential to deposit whilst titanium is depositing and for the other elements it can be assumed that the very low concentrations lead to low concentration gradients and hence low mass transfer in the melt. Cr, Fe and Si could be removed by treating the melt with titanium where the following reaction will occur.

$$MCl_2+Ti=TiCl_2+M$$

where M is either Cr, Fe or Si or a portion of the electrolyte removed and discarded Treatment of the electrolyte with titanium at 700° C. removes many of the impurities down to very low levels, such as Cr 0.003 wt % Fe $4\times10^{-6}$ wt %, Si $6\times10^{-9}$ wt % which will give a titanium product with an even lower level of impurities.

The invention claimed is:

1. A method of producing titanium, comprising:

providing an oxide of titanium in the form of an ore or ore concentrate comprising at least 90 wt % titanium oxide and impurities in the form of oxides of silicon, aluminum, iron, calcium, and chromium, the ore or ore concentrate having a level of impurities of at least 1.0 wt %, including at least 0.1 wt % calcium oxide and/or at least 0.1 wt % iron oxide;

reacting the oxide of titanium to form a titanium oxycarbide; and electrolysing the titanium oxycarbide in a molten salt electrolyte comprising a chloride of an alkali or alkali-earth metal, with the titanium oxycarbide configured as an anode;

recovering a refined titanium metal from a cathode in the electrolyte, the refined titanium metal having a level of impurities of less than 0.5 wt %; and removing impurities from the electrolyte by treating the molten salt with titanium.

2. A method according to claim 1, in which the refined titanium metal is at least 99.8% pure by weight.

3. A method according to claim 1, in which the oxide of titanium has a level of impurities of at least 2.5 wt %.

4. A method according to claim 1, in which impurities in the ore or ore concentrate further comprise vanadium.

5. A method according to claim 1, in which the oxide of titanium includes at least 0.5 wt % calcium oxide and/or at least 0.5 wt % iron oxide.

6. A method according to claim 1, in which the titanium oxycarbide is formed by reacting the oxide of titanium with titanium carbide.

7. A method according to claim 6, in which titanium carbide is reacted with titanium dioxide in accordance with the stoichiometry given by: $4TiC+2TiO_2=3Ti_2CO+CO_{(g)}$.

8. A method according to claim 1, in which the molten salt is selected from the group consisting of lithium chloride, sodium chloride, potassium chloride, magnesium chloride and any mixtures thereof.

9. A method according to claim 8, in which the molten salt is one of a sodium chloride-potassium chloride eutectic and a lithium chloride-sodium chloride-potassium chloride eutectic.

10. A method according to claim 1, in which the molten salt electrolyte further comprises a chloride of titanium selected from the group consisting of titanium (II) chloride and titanium (III) chloride.

11. The method of claim 1, wherein the refined titanium metal has a lower level of iron, calcium, aluminum, chromium, and silicon impurities than the ore or ore concentrate.

12. A method of producing titanium, comprising:

providing an oxide of titanium in the form of an ore or ore concentrate comprising at least 90 wt % titanium oxide, the ore or ore concentrate having a level of impurities of at least 2.0 wt %, including at least 0.5 wt % iron oxide;

reacting the oxide of titanium to form a titanium oxycarbide; and electrolysing the titanium oxycarbide in a molten salt electrolyte comprising a chloride of an alkali or alkali-earth metal, with the titanium oxycarbide configured as an anode;

recovering a refined titanium metal from a cathode in the electrolyte, the refined titanium metal having a level of impurities of less than 0.5 wt % and with a lower level of iron than in the oxide of titanium.

* * * * *